United States Patent [19]

Phillips et al.

[11] Patent Number: 5,017,824

[45] Date of Patent: May 21, 1991

[54] TFEL EDGE EMITTER MODULE AND PACKAGING ASSEMBLY EMPLOYING SEALED CAVITY CAPACITY VARYING MECHANISM

[75] Inventors: Norman J. Phillips, Penn Hills; David Leksell, Oakmont; Henry A. Wehrli, III, Monroeville, all of Pa.; William A. Barrow, Beaverton; Mark S. Kruskopf, Portland, both of Oreg.

[73] Assignee: Westinghouse Electric Corp., Pittsburgh, Pa.

[21] Appl. No.: 434,392

[22] Filed: Nov. 13, 1989

[51] Int. Cl.[5] ..... H01J 7/24

[52] U.S. Cl. ..... 313/13; 313/33; 313/36; 313/512

[58] Field of Search ..... 313/13, 33, 35, 36, 313/506, 509, 512

[56] References Cited

U.S. PATENT DOCUMENTS

| | | | |
|---|---|---|---|
| 4,006,383 | 2/1977 | Luo et al. | 315/169 TV |
| 4,110,664 | 8/1978 | Asars et al. | 315/169 TV |
| 4,464,602 | 8/1984 | Murphy | 313/509 |
| 4,535,341 | 8/1985 | Kun et al. | 346/107 R |
| 4,734,723 | 3/1988 | Ishitobi | 346/160 |
| 4,807,047 | 2/1989 | Sato et al. | 358/300 |

FOREIGN PATENT DOCUMENTS 63-91998 4/1988 Japan .

*Primary Examiner*—Kenneth Wieder
*Assistant Examiner*—Brian Zimmerman
*Attorney, Agent, or Firm*—John K. Williamson

[57] ABSTRACT

A thin film electroluminescent (TFEL) edge emitter module and packaging assembly is composed of a TFEL edge emitter module including an electroluminescent (EL) stack having a linear array of spaced-apart pixels with light-emitting front edges, an enclosure defining a sealed cavity which encloses at least a portion of the EL stack so as to sealably enclose the array of pixels in a contaminant-free environment, a thermally expansive and contractive liquid substantially filling the sealed cavity, and a cavity capacity expansion and contraction mechanism disposed in the enclosure in communication with the cavity and the liquid therein. In response to thermal expansion of the volume of the liquid filling the cavity, the capacity expansion and contraction mechanism is operable to change from a first condition toward a second condition and thereby increase the liquid-holding capacity of the enclosure cavity. Further, in response to thermal contraction of the volume of the liquid, the mechanism is operable to change from the second condition back toward the first condition and thereby decrease the liquid-holding capacity of the enclosure cavity. In such manner, the enclosure cavity liquid-holding capacity is continually maintained substantially equivalent to the enclosed volume of liquid filling the cavity.

15 Claims, 4 Drawing Sheets

TFEL EDGE EMITTER MODULE AND PACKAGING ASSEMBLY EMPLOYING SEALED CAVITY CAPACITY VARYING MECHANISM

CROSS REFERENCE TO RELATED APPLICATIONS

Reference is hereby made to the following copending U. S. applications dealing with related subject matter and assigned to the assignee of the present invention:

1. "A Thin Film Electroluminescent Edge Emitter Structure On A Silicon Substrate" by Z. K. Kun et al, assigned U.S. Ser. No. 273,296 and filed Nov. 18, 1988, a continuation-in-part of U.S. Ser. No. 235,143, filed Aug. 23, 1988.

2. "Process For Defining An Array Of Pixels In A Thin Film Electroluminescent Edge Emitter Structure" by W. Kasner et al, assigned U.S. Ser. No. 254,282 and filed Oct. 6, 1988, which issued as U.S. Pat. No. 4,885,448 on Dec. 5, 1989.

3. "A Multiplexed Thin Film Electroluminescent Edge Emitter Structure And Electronic Drive System Therefor" by D. Leksell et al, assigned U.S. Ser. No. 343,697 and filed Apr. 24, 1989, which issued as U.S. Pat. No. 4,899,184 on Feb. 6, 1990.

4. "A Thin Film Electroluminescent Edge Emitter Assembly And Integral Packaging" by Z. K. Kun et al, assigned U.S. Ser. No. 351,495 and filed May 15, 1989, which issued as U.S. Pat. No. 4,951,064 on Aug. 21, 1990.

5. "Thin Film Electroluminescent Edge Emitter Structure With Optical Lens And Multi-Color Light Emission Systems" by Z. K. Kun et al, assigned U.S. Ser. No. 353,316 and filed May 17, 1989, a continuation-in-part of U.S. Ser. No. 280,909, filed Dec. 7, 1988, which is a continuation-in-part of U.S. Ser. No. 248,868, filed Sept. 23, 1988.

6. "Integrated TFEL Flat Panel Face And Edge Emitter Structure Producing Multiple Light Sources" by Z. K. Kun et al, assigned U.S. Ser. No. 377,690 and filed July 10, 1989.

7. "Multi-Layer Structure And Method Of Constructing The Same For Providing TFEL Edge Emitter Modules" by Norman J. Phillips et al, assigned U.S. Ser. No. 07/434,397 and filed Nov. 13, 1989.

BACKGROUND OF THE INVENTION

1. Field of the Invention

The present invention relates generally to an electronically controlled, high resolution light source, and more particularly, to a thin film electroluminescent (TFEL) edge emitter module and packaging assembly having a sealed cavity employing a capacity varying mechanism therein.

2. Description of the Prior Art

Electroluminescence is a phenomena which occurs in certain materials from the passage of an electric current through the material The electric current excites the electrons of the dopant in the light emitting material to higher energy levels. Emission of radiation thereafter occurs as the electrons emit or give up the excitation energy and fall back to lower energy levels Such electrons can only have certain discrete energies Therefore, the excitation energy is emitted or radiated at specific wavelengths depending on the particular material. TFEL devices that employ the electroluminescence phenomena have been devised in the prior art. It is well known t utilize a TFEL device to provide an electronically controlled, high resolution light source. One arrangement which utilizes the TFEL device to provide the light source is a flat panel display system, such as disclosed in Asars et al U.S. Pat. No. (4,110,664) and Luo et al U.S. Pat. No. (4,006,383), assigned to the assignee of the present invention. In a TFEL flat panel display system, light emissions are produced substantially normal to a face of the device and so provide the light source at the device face. Another arrangement utilizing the TFEL device to provide the light source is a line array, or edge, emitter, such as disclosed in a Kun et al U.S. Pat. No. (4,535,341), also assigned to the assignee of the present invention. In a TFEL edge emitter system, light emissions are produced substantially normal to an edge of the TFEL device and so provide the light source at the device edge. Edge emissions by the TFEL edge emitter system are typically 30 to 40 times brighter than the face emissions by the TFEL flat panel display system under approximately the same excitation conditions.

From the above discussion, it can be appreciated that the TFEL edge emitter system of the Kun et al patent potentially provides a high resolution light source promising orders of magnitude of improved performance over the TFEL flat panel face emitter system in terms of light emission brightness. For the TFEL edge emitter device to be able to reach its full commercial potential, it must be capable of use in applications where potentially harmful contaminants, such as moisture and airborne particulates, will be present.

One packaging assembly has been devised to provide a contaminant-free environment for the TFEL edge emitter device to permit its use in such applications. Such packaging assembly is disclosed in the fourth patent application cross-referenced above. This packaging assembly includes a sealed enclosure having an internal sealed cavity surrounding the light emitting edge of the TFEL edge emitter device and a front translucent glass window through which can pass light energy emitted by the TFEL edge emitter device. Also, the packaging assembly includes an oil-like liquid which fills the internal sealed cavity. The liquid has an index of refraction which matches the index of refraction of either the front glass window or the electroluminescent (EL) stack of the TFEL edge emitter device One serious problem which has been encountered with the packaging assembly of the above-described construction is that the sealed enclosure is so rigid that thermal expansion of the liquid inside the sealed cavity due to as little as a 20° C. increase in temperature can cause the enclosure to rupture and leak. In order to ensure the durability of the packaging assembly and the performance of the TFEL edge emitter device, there is a pressing need to devise a cost effective and efficient technique for preventing enclosure rupture.

SUMMARY OF THE INVENTION

The present invention relates to TFEL edge emitter module and packaging assembly designed to satisfy the aforementioned needs. The present invention provides a capacity varying mechanism which will accommodate thermal expansion of the liquid by increasing the enclosure cavity capacity, thereby absorbing the increase in liquid volume and preventing the rupture of the sealed enclosure. The capacity varying mechanism of the present invention further will contract the capacity of the cavity as the liquid cools so as to maintain the cavity liquid-holding capacity substantially equivalent to the enclosed volume of liquid Accordingly, the present invention is directed to a capacity varying mechanism employed in a TFEL edge emitter module and packaging assembly The assembly includes a TFEL edge emitter module with an EL stack having a light-emitting front edge, an enclosure defining a sealed cavity enclosing at least a portion of the EL stack, and a thermally expansive and contractive liquid substantially filling the sealed cavity.

The capacity varying mechanism can be in any one of several embodiments. In one embodiment, the mechanism includes a rigid hollow tube and a piston sealably mounted therein. The tube is closed at one end and open at an opposite end, with the open end being in communication with the cavity and liquid therein. The piston is slidably mounted within the tube for reciprocable movement away from or toward the open tube end in response to thermal expansion or contraction of the liquid in the cavity. Also, a quantity of gas is contained in the tube between the piston and the closed end of the tube. Further, a stop is defined on the tube near its open end for preventing movement of the piston through the open tube end in order to retain the piston within the tube.

In another embodiment, the mechanism includes a flexible hollow tube closed at its opposite ends so as to define a sealed chamber therebetween and a quantity of gas contained in the tube chamber between the opposite closed ends thereof. The sealed flexible tube is contractible or expandable in response to thermal expansion or contraction of the liquid in the cavity.

In yet another embodiment, the mechanism includes a passage defined through a wall of the enclosure communicating between the cavity and the enclosure exterior and a flexible diaphragm attached to the enclosure wall and extending across and sealably blocking the passage. The diaphragm is expandable or contractible in response to thermal expansion or contraction of the liquid in the cavity.

Also, the present invention is directed to a TFEL edge emitter module and thermally-compensated packaging assembly. The assembly includes an EL stack having a linear array of spaced-apart pixels with light-emitting front edges, an enclosure defining a sealed cavity containing at least a portion of the EL stack so as to sealably enclose the array of pixels in a contaminant-free environment, a thermally expansive and contractive liquid substantially filling the sealed cavity, and a cavity capacity expansion and contraction mechanism disposed in communication with the cavity and the liquid therein. In response to thermal expansion of the volume of liquid filling the cavity, the capacity expansion mechanism is operable to change from a first condition toward a second condition and thereby increase the liquid-holding capacity of the enclosure cavity. Further, in response to thermal contraction of the volume of the liquid, the mechanism is operable to change from the second condition back toward the first condition and thereby decrease the liquid-holding capacity of the enclosure cavity. In such manner, the enclosure cavity liquid-holding capacity is continually maintained substantially equivalent to the enclosed volume of liquid filling the cavity.

These and other features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which.

DESCRIPTION OF THE PREFERRED EMBODIMENTS

In General

Figure 1:
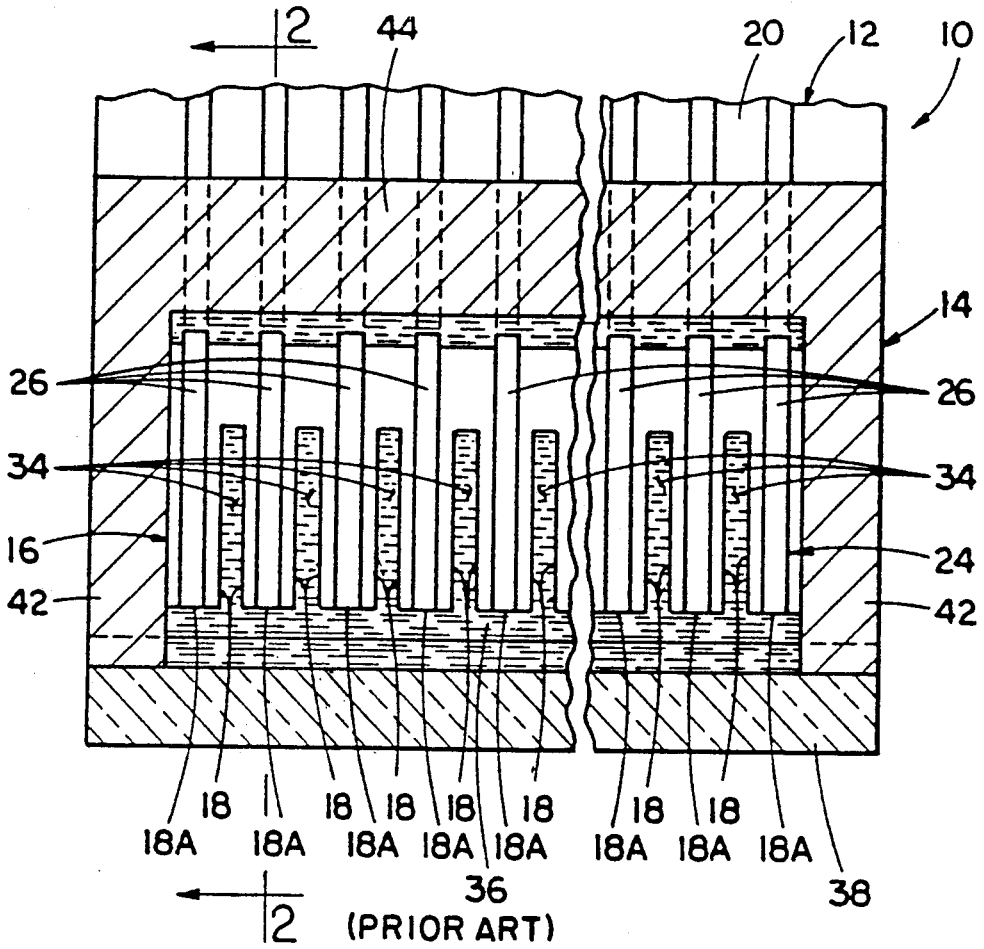
(PRIOR ART) FIG. 1
FIG. 1 is a fragmentary longitudinal horizontal sectional view of a TFEL edge emitter module and packaging assembly taken along line 1—1 of FIG. 2.
Figure 2:
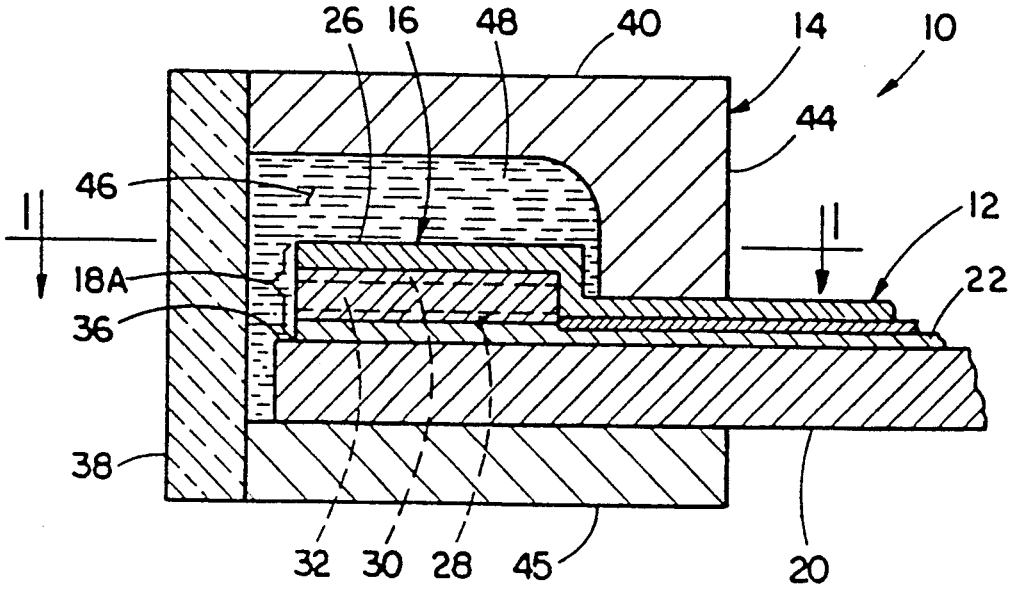
(PRIOR ART) FIG. 2
FIG. 2 is a fragmentary longitudinal vertical sectional view of the assembly taken along line 2—2 of FIG. 1.

Referring to the drawings, and particularly to FIGS. 1 and 2, there is illustrated a TFEL edge emitter module and packaging assembly, generally designated 10. The module and packaging assembly 10 is substantially similar in construction to the one disclosed and illustrated in the fourth patent application cross-referenced above, the disclosure of which is incorporated herein by reference. The basic construction of the assembly 10 need and will only be described herein to the extent necessary to foster a complete and thorough understanding of the present invention.

The module and packaging assembly 10 basically includes a TFEL edge emitter module 12 and a sealed liquid-containing enclosure 14. The TFEL edge emitter module 12 employs an electroluminescent (EL) stack 16 having a linear array of spaced-apart pixels 18 with light-emitting front edges 18A. The TFEL edge emitter module 12 provides a solid state, electronically controlled, high resolution light source.

The TFEL edge emitter module 12 includes a bottom substrate layer 20, preferably fabricated of a glass material, a lower common electrode layer 22 applied over the bottom substrate layer 20, an upper electrode layer 24 composed of a plurality of upper control electrode elements 26, and the middle EL light-energy generating stack 16 disposed between the lower common electrode 22 and the upper control electrode elements 26. The middle EL stack 16 includes a lower dielectric layer 28, an upper dielectric layer 30, and a middle light-energy generating layer 32. The lower dielectric layer 28, preferably composed of silicon oxide nitride, overlies the lower common electrode layer 22 and bottom substrate layer 20. Next, the middle light-energy generating layer 32, preferably composed of a phosphor material such as zinc sulfide doped with manganese, is deposited over the lower dielectric layer 28. Then, the upper dielectric layer 30, composed of the same material as the lower dielectric layer 28, is deposited over the middle light-sectional energy generating layer 32.

It should be understood that although the EL stack 16 is illustrated including lower and upper dielectric layers 28, 30, the lower dielectric layer 28 may be eliminated from the EL stack 16 if desired. If the lower dielectric layer 28 is not included in the EL stack 16, then it is apparent that the phosphor layer 32 will be interposed between the lower common electrode layer 24 and the upper dielectric layer 30.

The linear array of pixels 18 of the EL stack 16, which also include the lower common and upper control electrode layers 22, 24, are defined by a series of longitudinal channels 34 and a transverse street 36 connecting the channels 34 on the forward end of the EL stack 16 and electrode layers 22, 24 down to the level of the bottom substrate layer 20. The channels 34 serve to optically isolate adjacent pixels 18 from one another to prevent optical cross-talk. The street 36 is provided as a result of the formation thereabove of the front light-emitting edges 18A of the pixels 18.

The sealed liquid-containing enclosure 14 of the assembly 10 is constructed of front, top, opposite side, rear and bottom wall portions 38, 40, 42, 44, 45. Although not required, all of the wall portions can be composed of a translucent glass. It is only required that at least the front wall portion 38 be translucent to provide a window through which light energy emitted by the front edges 18A of the pixels 18 can pass from the interior to exterior of the sealed enclosure 14. The bottom wall portion 45 is adhesively attached to the bottom side of the bottom substrate 20 of the module 12. The top, opposite side, and rear wall portions 40, 42, 44 are preferably formed from a single piece. The opposite side wall portions 42 are adhesively attached to the top side of the bottom substrate 20. The rear wall portion 44 is attached to the top side of the module 12 rearwardly of the pixels 18. The front wall portion 38 is adhesively attached to the fronts of the top, opposite side and bottom wall portions 40, 42, 45. The front, top, opposite side, rear and bottom wall portions 38, 40, 42, 44, 45 of the enclosure 14 when so sealed with one another and with the bottom and top of the TFEL edge emitter module 12 define a sealed cavity 46 which surrounds and encloses at least a portion of the EL stack 16 so as to sealably enclose the linear array of pixels 18 in a contaminant-free environment.

Also, the assembly 10 includes a thermally expansive and contractive oil-type liquid 48 which substantially fills the sealed cavity 46 surrounding the portions of the EL stack 16. The liquid 48 has an index of refraction which matches the index of refraction of either the translucent enclosure front wall portion 38 or the EL stack 16.

Enclosure Cavity Capacity Varying Mechanism

Turning now to FIGS. 3–8, there is illustrated several embodiments of a capacity varying mechanism 50 which is employed in the TFEL edge emitter module and packaging assembly 10 in accordance with the present invention to compensate for thermal expansion and contraction of the oil-type liquid 48 filling the enclosure cavity 46. The construction of the TFEL edge emitter module 12 and the enclosure 14 and the use of the liquid 48 of the module and packaging assembly 10 are the same as described above with reference to FIGS. 1 and 2.

Figure 3:
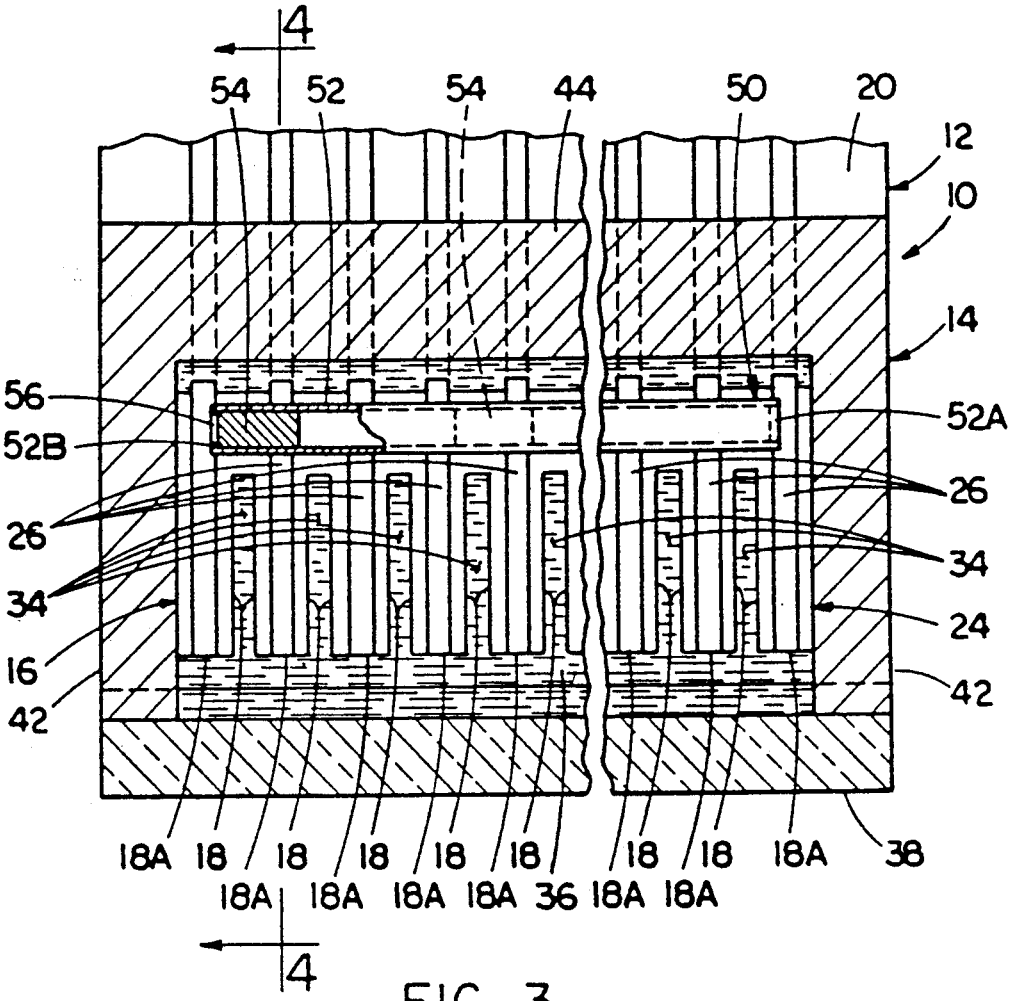
FIG. 3 is a fragmentary longitudinal horizontal sectional view of a TFEL edge emitter module and thermally-compensated packaging assembly taken along line 3—3 of FIG. 4, illustrating one embodiment of a capacity varying mechanism employed in the assembly in accordance with the present invention.
Figure 4:
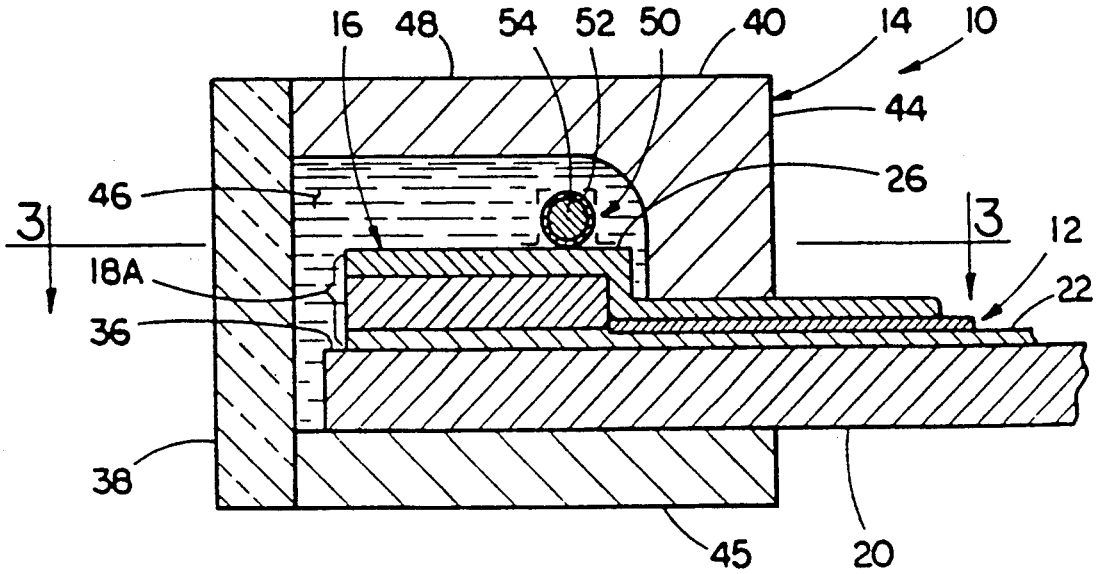
FIG. 4 is a fragmentary longitudinal vertical sectional view of the assembly and capacity varying mechanism taken along line 4–4 of FIG. 3.

Referring to FIGS. 3 and 4, there is shown a first embodiment of the capacity varying mechanism 50. In this embodiment, the capacity varying mechanism 50 includes a rigid hollow tube 52 and a piston 54 sealably mounted therein. By way of example, the tube 52 can be composed of stainless steel material and the piston 54 can be composed of a low friction material, such as one sold under the trademark, Teflon. The tube 52 is disposed within the sealed cavity 46 of the enclosure 14, extending across the pixels 18. The tube 52 is closed at one end 52A and open at an opposite end 52B. A quantity of gas is contained in the tube 52 between the piston 54 and the closed end 52A of the tube 52. The open end 52B of the tube 52 is in communication with the sealed cavity 46 and the liquid 48 contained therein The piston 54 is slidably mounted within the tube 52 for reciprocable movement away from or toward the open tube end 52B in response to thermal expansion or contraction of the liquid 48 in the cavity 46. Further, a stop, for example in the form of an inturned rim 56, is defined on the tube 52 at or near its open end 52B for preventing movement of the piston 54 through the open tube end 52B in order to retain the piston 54 within the tube 52.

When the piston 54 of mechanism 50 is disposed adjacent the open end 52B of the tube 52 as shown in full line form in FIG. 3, the mechanism 50 is in a contracted condition which decreases the liquid-holding capacity of the sealed cavity 46. On the other hand, when the piston 54 is disposed intermediately between the opposite ends 52A, 52B of the tube 52 as shown in dash line form in FIG. 3, the mechanism 50 is in an expanded condition which increases the liquid-holding capacity of the sealed cavity 46. Thermal expansion of the liquid 48, such as occurs when heated by normal operation of the TFEL edge emitter module 12, causes the piston 54 to move further into the tube 52 toward the dashed line position of the piston and compress the gas contained in the tube 52. Conversely, thermal contraction of the liquid 48, such as occurs when cooled by discontinuing operation of the module 12, permits expansion of the compressed gas and movement of the piston 54 thereby toward its full line position.

Figure 5:
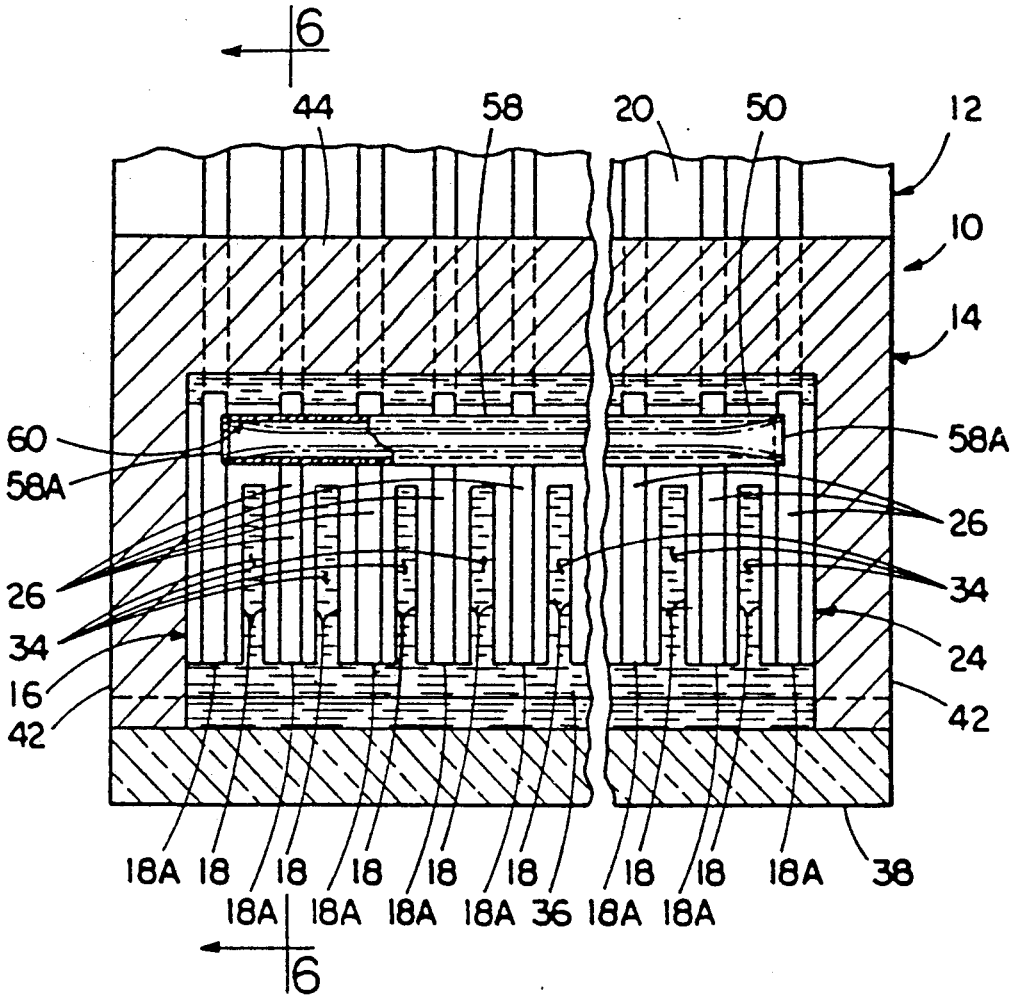
FIG. 5 is a fragmentary longitudinal horizontal sectional view of the TFEL edge emitter module and thermally-compensated packaging assembly taken along line 5—5 of FIG. 6, illustrating another embodiment of the capacity varying mechanism employed in the assembly in accordance with the present invention.
Figure 6:
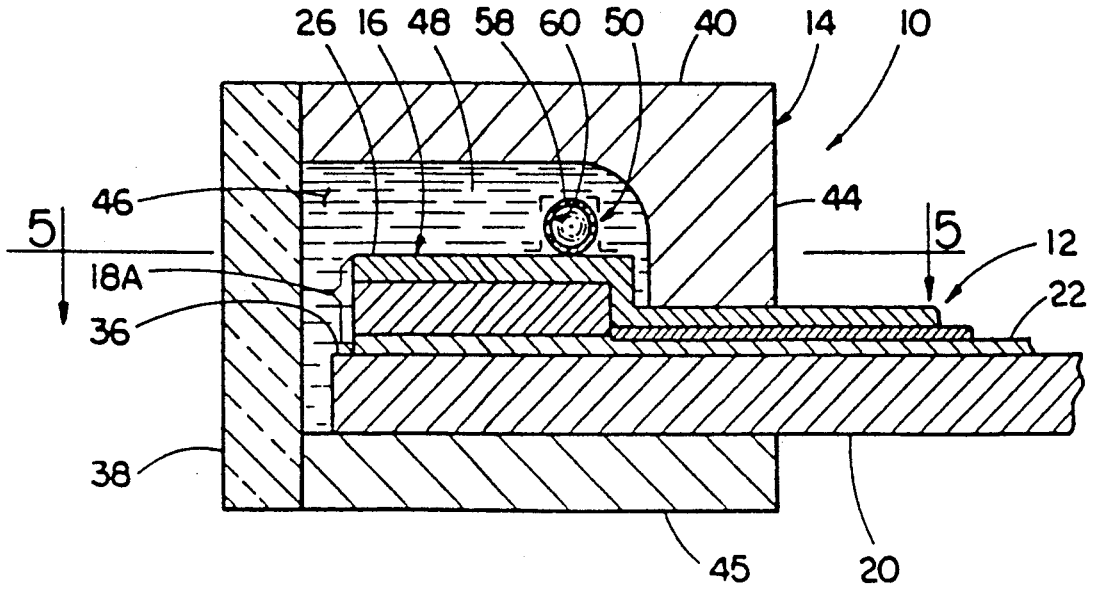
FIG. 6 is a fragmentary longitudinal vertical sectional view of the assembly and capacity varying mechanism taken along line 6—6 of FIG. 5.

Referring to FIGS. 5 and 6, there is shown an alternative, second embodiment of the capacity varying mechanism 50. In this embodiment, the capacity varying mechanism 50 includes a flexible hollow tube 58 closed at its opposite ends 58A so as to define a sealed chamber 60 therebetween and a quantity of gas, such as dry nitrogen, contained in the tube chamber 60 between the opposite closed ends 58A thereof. The sealed flexible tube 58 is contractible to the dashed line condition or expandable to the full line condition in response to thermal expansion or contraction of the liquid 48 in the sealed enclosure cavity 46.

Figure 7:
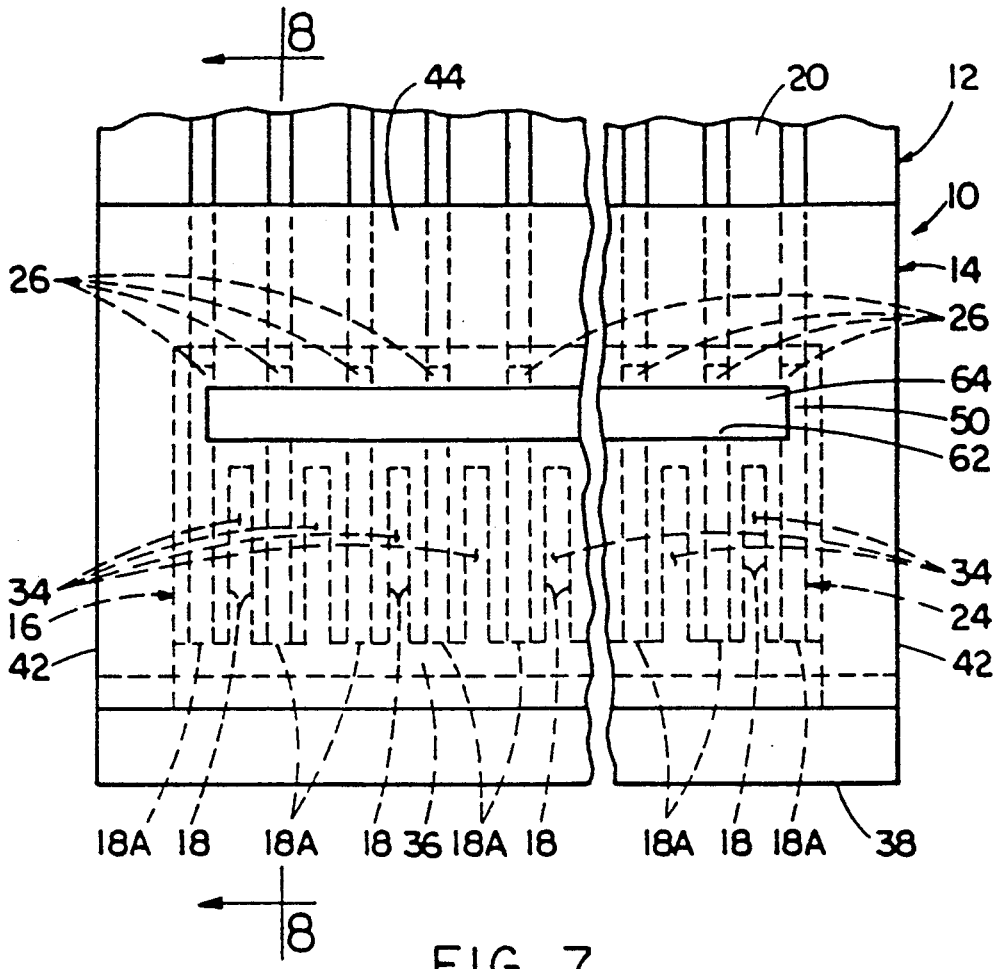
FIG. 7 is a fragmentary longitudinal horizontal sectional view of the TFEL edge emitter module and thermally-compensated packaging assembly taken along line 7—7 of FIG. 8, illustrating yet another embodiment of the capacity varying mechanism employed in the assembly in accordance with the present invention.
Figure 8:
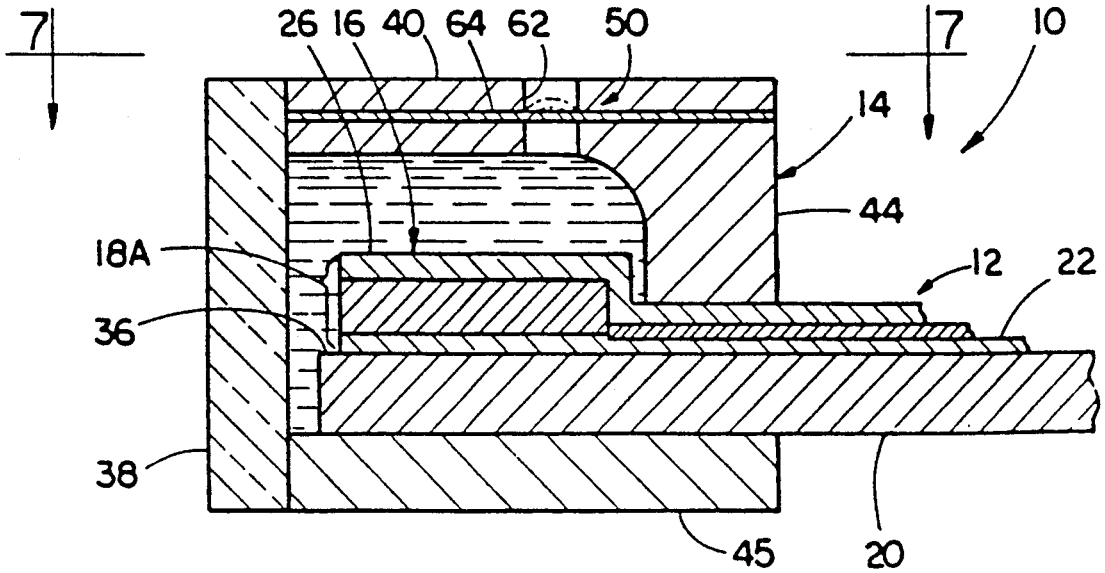
FIG. 8 is a fragmentary longitudinal vertical sectional view of the assembly and capacity varying mechanism taken along line 8—8 of FIG. 7.

Referring to FIGS. 7 and 8, there is shown an alternative, third embodiment of the capacity varying mechanism 50. In this embodiment, the capacity varying mechanism 50 includes a passage 62 defined through the top wall portion 40 of the enclosure 14 which communicates between the cavity 46 and the enclosure exterior. Further, a flexible bladder or diaphragm 64 is attached to the enclosure top wall portion 40 and extends across and sealably blocks the passage 62. By way of the illustrated example, the diaphragm 64 can be attached to the enclosure 14 by being sandwiched between two pieces of material defining the top wall portion 40 of the enclosure 14. As seen in FIG. 8, the diaphragm 64, which can be composed of a metallic material such as an aluminum foil type material, is expandable to the dashed line condition or contractible to the full line condition in response to thermal expansion or contraction of the liquid 48 in the cavity 46 which increases or decreased the liquid-holding capacity of the cavity.

As is the case of the mechanisms 50 of the other two embodiments, the diaphragm 64 of this embodiment functions to continuously adjust and maintain the liquid-holding capacity of the cavity 46 to substantially match the volume of the liquid 48. The mechanisms 50 of all embodiments function dependably to prevent rupture of the enclosure 14 as the liquid 48 changes in volume due to fluctuations in the temperature of the liquid. In such manner, the module and packaging assembly 10 is thermally compensated to accommodate such temperature changes.

It is thought that the present invention and many of its attendant advantages will be understood from the foregoing description and it will be apparent that various changes may be made in the form, construction and arrangement of the parts of the invention described herein without departing from the spirit and scope of the invention or sacrificing all of its material advantages, the forms hereinbefore described being merely preferred or exemplary embodiments thereof

We claim:

1. In combination with a thin film electroluminescent (TFEL) edge emitter module and packaging assembly including a TFEL edge emitter module with an electroluminescent (EL) stack having a light-emitting front edge, an enclosure defining a sealed cavity enclosing at least a portion of said EL stack, and a thermally expansive and contractive liquid substantially filling said sealed cavity, means for varying the liquid-holding capacity of said cavity, comprising:

a capacity expansion and contraction mechanism disposed in communication with said cavity and said liquid therein, said mechanism, in response to thermal expansion or contraction of the volume of said liquid filling said cavity, being operable to correspondingly change from a first to second condition or vice versa and thereby respectively increase or decrease the liquid-holding capacity of said enclosure cavity such that said enclosure cavity liquid-holding capacity is continually maintained substantially equivalent to the enclosed volume of said liquid filling said cavity.

2. The assembly as recited in claim 1, wherein said capacity expansion and contraction mechanism includes:

a substantially rigid hollow tube closed at one end and open at an opposite end, said open tube end being in communication with said cavity and said liquid therein;

a piston sealably and slidably mounted within said tube for reciprocable movement away from or toward said open tube end in response to thermal expansion or contraction of said liquid in said cavity; and a quantity of gas contained in said tube between said piston and said closed end of said tube.

3. The assembly as recited in claim 2, wherein said tube has a stop defined thereon near its open end for preventing movement of said piston through said open tube end in order to retain said piston within said tube.

4. The assembly as recited in claim 1, wherein said capacity expansion and contraction mechanism includes:

a substantially flexible hollow tube closed at its opposite ends so as to define a sealed chamber therebetween; and a quantity of gas contained in said tube between said opposite closed ends thereof, said sealed flexible tube being contractible or expandable in response to thermal expansion or contraction of said liquid in said cavity.

5. The assembly as recited in claim 4, wherein said gas is dry nitrogen.

6. The assembly as recited in claim 1, wherein said capacity expansion and contraction mechanism includes:

means defining a passage in said enclosure which communicates between said cavity of said enclosure and the exterior of said enclosure; and a flexible diaphragm attached to said enclosure and extending across and sealably blocking said passage, said diaphragm being expandable or contractible in response to thermal expansion or contraction of said liquid in said cavity.

7. The assembly as recited in claim 6, wherein said diaphragm is composed of a metallic foil-type material 8. A thin film electroluminescent (TFEL) edge emitter module and packaging assembly, comprising in combination:

(a) a TFEL edge emitter module including an electroluminescent (EL) stack having a linear array of spaced-apart pixels with light-emitting front edges;

(b) an enclosure defining a sealed cavity enclosing at least a portion of said EL stack so as to sealably enclose said array of pixels in a contaminant-free environment;

(c) a thermally expansive and contractive liquid substantially filling said sealed cavity; and (d) means disposed in communication with said sealed cavity and said liquid therein for varying the liquid-holding capacity of said enclosure cavity in response to thermal expansion and contraction of said liquid.

9. The assembly as recited in claim 8, wherein said capacity varying means is a capacity expansion and contraction mechanism being operable, in response to thermal expansion or contraction of the volume of said liquid filling said cavity, to correspondingly change from a first to second condition or vice versa and thereby respectively increase or decrease the liquid-holding capacity of said enclosure cavity such that said enclosure cavity liquid-holding capacity is continually maintained substantially equivalent to the enclosed volume of said liquid filling said cavity.

10. The assembly as recited in claim 8, wherein said capacity varying means includes:

a substantially rigid hollow tube closed at one end and open at an opposite end, said open tube end being in communication with said cavity and said liquid therein;

a piston sealably and slidably mounted within said tube for reciprocable movement away from or toward said open tube end in response to thermal expansion or contraction of said liquid in said cavity; and a quantity of gas contained in said tube between said piston and said closed end of said tube.

11. The assembly as recited in claim 10, wherein said tube has a stop defined thereon near its open end for preventing movement of said piston through said open tube end in order to retain said piston within said tube.

12. The assembly as recited in claim 8, wherein said capacity varying means includes:

a substantially flexible hollow tube closed at its opposite ends so as to define a sealed chamber therebetween; and a quantity of gas contained in said tube between said opposite closed ends thereof, said sealed flexible tube being contractible or expandable in response to thermal expansion or contraction of said liquid in said cavity.

13. The assembly as recited in claim 12, wherein said gas is dry nitrogen.

14. The assembly as recited in claim 8, wherein said capacity varying means includes:

means defining a passage in said enclosure which communicates between said cavity of said enclosure and the exterior of said enclosure; and a flexible diaphragm attached to said enclosure and extending across and sealably blocking said passage, said diaphragm being expandable or contractible in response to thermal expansion or contraction of said liquid in said cavity.

15. The assembly as recited in claim 14, wherein said diaphragm is composed of a metallic foil-type material.

* * * * *